United States Patent [19]

Cherryholmes

[11] Patent Number: 4,569,329

[45] Date of Patent: Feb. 11, 1986

[54] REFLECTOR FOR RADIANT HEATER

[75] Inventor: John T. Cherryholmes, Potwin, Kans.

[73] Assignee: The Coleman Company, Inc., Wichita, Kans.

[21] Appl. No.: 576,035

[22] Filed: Feb. 1, 1984

[51] Int. Cl.[4] ..... F24C 3/04

[52] U.S. Cl. ..... 126/92 B; 126/92 R; 362/277; 431/258; 431/329

[58] Field of Search ..... 126/92 B, 92 R, 92 AC, 126/92 A, 91 R; 362/277–279; 34/4, 99; 431/327, 329, 258, 259, 328, 353, 354

[56] References Cited

U.S. PATENT DOCUMENTS

| | | | |
|---|---|---|---|
| 820,127 | 5/1906 | Pope | 126/438 |
| 1,642,919 | 9/1927 | Cloughley | 362/277 |
| 2,336,816 | 12/1943 | Thompson | 126/92 B |
| 3,310,047 | 3/1967 | Budden | 126/92 B |
| 3,330,267 | 7/1967 | Bauer | 126/92 B |
| 3,731,668 | 5/1973 | Smith | 126/92 B |
| 4,141,060 | 2/1979 | Lackore et al. | 34/4 |
| 4,403,277 | 9/1983 | Eargle et al. | 362/277 |
| 4,429,351 | 1/1984 | Petzl | 362/277 |

FOREIGN PATENT DOCUMENTS

| | | | |
|---|---|---|---|
| 1143315 | 2/1963 | Fed. Rep. of Germany | 126/92 B |
| 599295 | 1/1926 | France | 126/92 B |
| 403490 | 12/1933 | United Kingdom | 126/92 B |

*Primary Examiner*—James C. Yeung

[57] ABSTRACT

A radiant heater includes a tilting and focusing reflector and a burner which is mounted inside of the reflector. The reflector can be tilted to direct radiant energy from the burner in a desired direction, and the focal point of the reflector can be moved with respect to the burner to concentrate, direct, or disperse radiant energy.

14 Claims, 20 Drawing Figures

FIG. 9
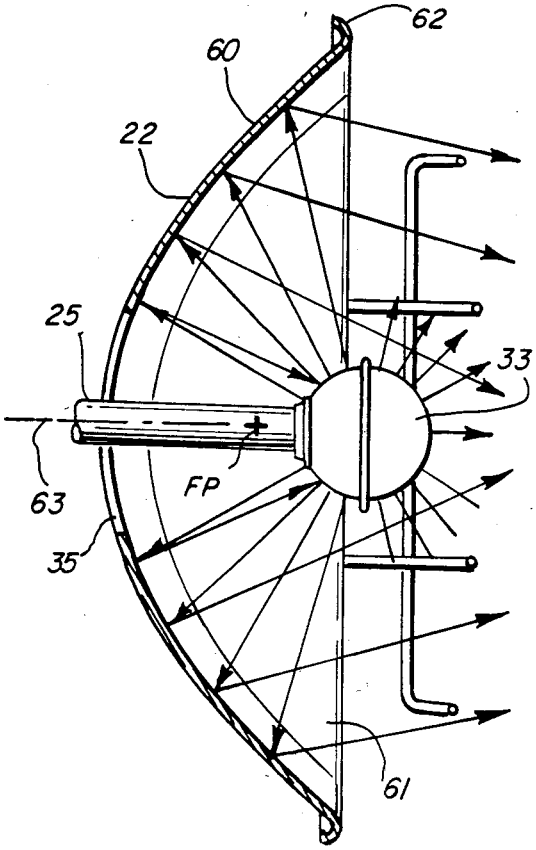
FIG. 10
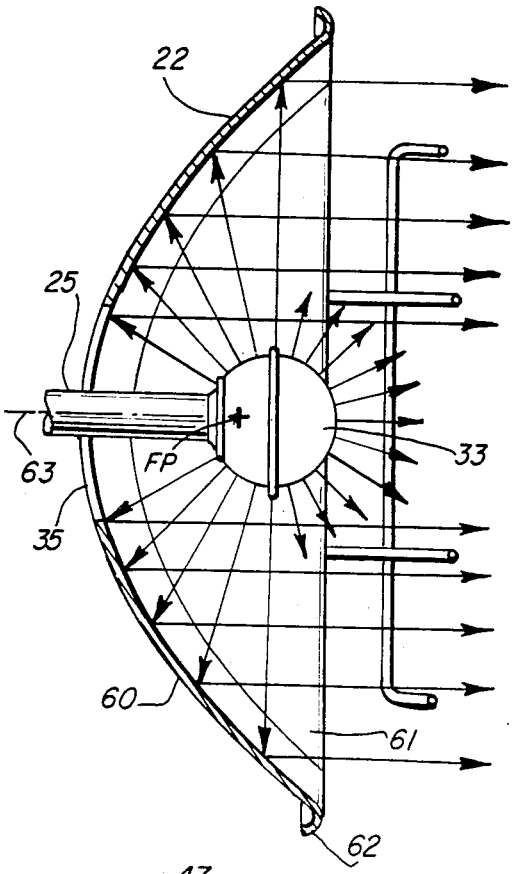
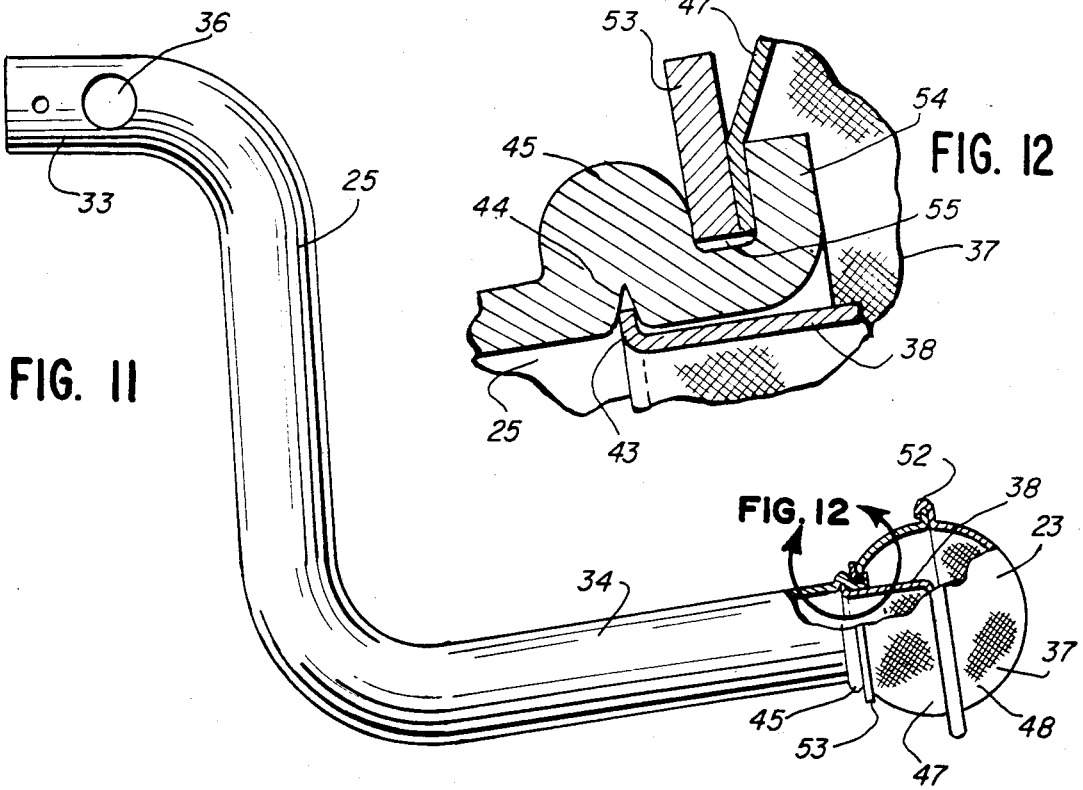
FIG. 11
FIG. 12

REFLECTOR FOR RADIANT HEATER

BACKGROUND AND SUMMARY

This invention relates to radiant heaters, and, more particularly, to a radiant heaters which is provided with a tilting and focusing reflector.

Radiant heater generally include a fuel source, such as propane or gasoline, a burner for burning the fuel in creating radiant heater energy, and a reflector for directing the radiant energy from the burner to the area which is to be heated. It is desirable that the reflector be movably mounted on the burner so that the radiant energy of the heater can be directed, dispersed, or concentrated.

In accordance with the invention the reflector is mounted for sliding movement toward and away from the burner so that focal point of the reflector can be positioned as desired. When the focal point is at the burner, radiant energy is focused and directed straight ahead in a concentrated beam. When the focal point is behind the burner, radiant energy is dispersed. The reflector is also mounted for tilting movement so that the direction in which the radient energy is directed can be varied.

DESCRIPTION OF THE DRAWING

The invention will be explained in conjunction with an illustrative embodiment shown in the accompanying drawings, in which—

FIG. 9 is a sectional view through the reflector showing the reflecting of radiant energy when the focal point of the reflector is behind the burner;

FIG. 10 is a sectional view through the reflector showing the reflecting of radiant energy when the focal point of the reflector is at the burner;

FIG. 11 is a side elevational view of the burner assembly;

FIG. 12 is an enlarged fragmentary sectional view of a portion of FIG. 11;

DESCRIPTION OF SPECIFIC EMBODIMENT

Figure 1:
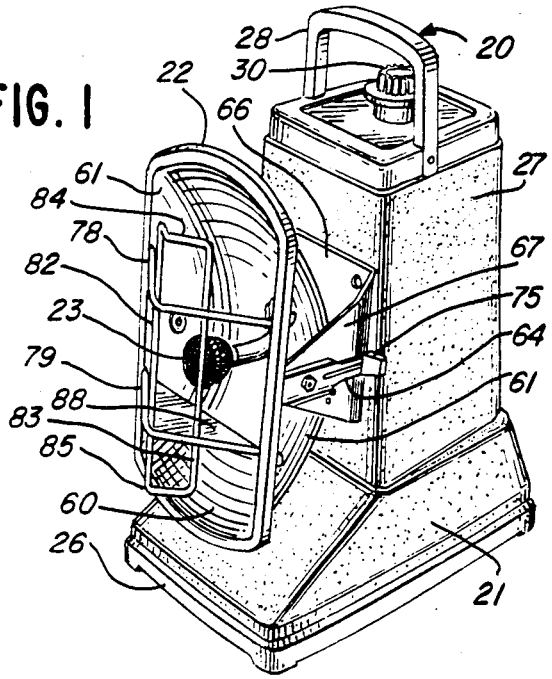
FIG. 1 is a perspective view of a radiant heater formed in accordance with the invention.
Figure 2:
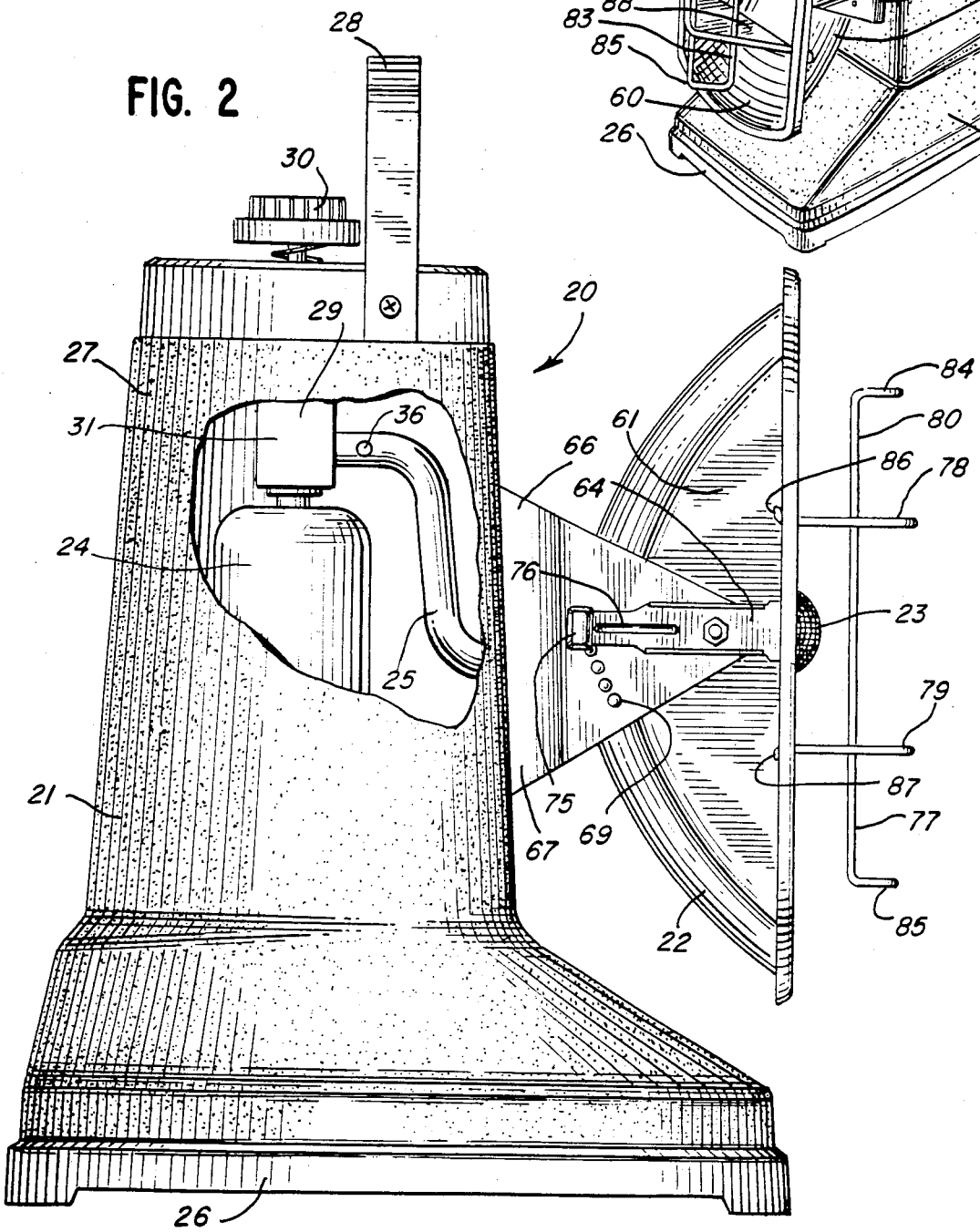
FIG. 2 is a side elevational view, partially broken away, of the heater of FIG. 1.
Figure 3:
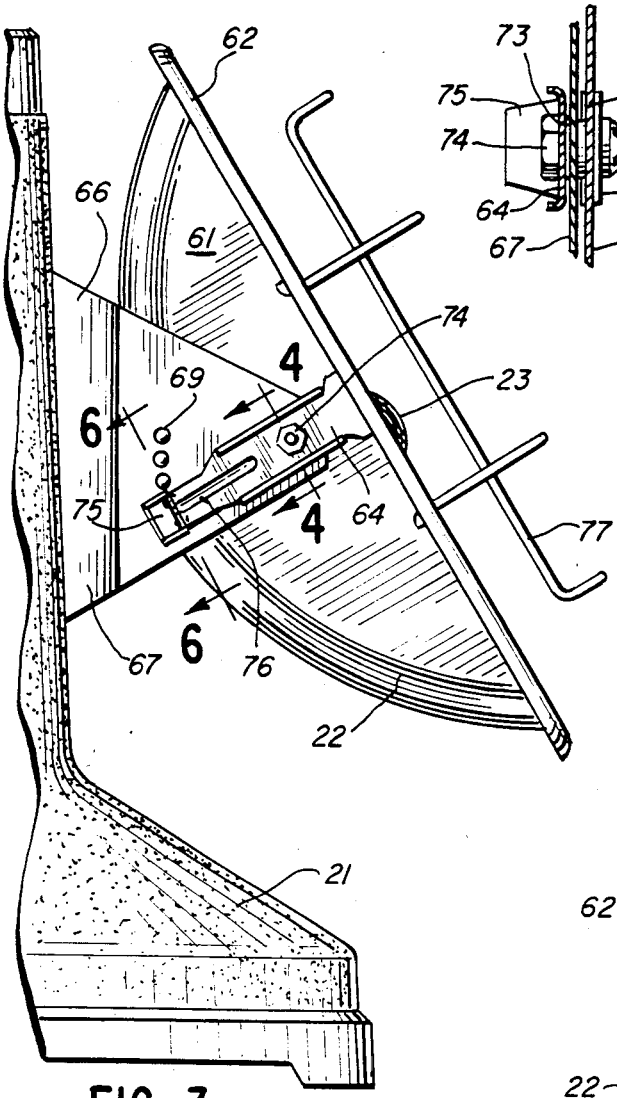
FIG. 3 is a fragmentary side elevational view showing the reflector tilted upwardly.

Referring first to FIGS. 1 and 2, a radiant heater 20 includes a base 21, a reflector 22, and a burner 23 mounted within the reflector. The particular heater illustrated is a propane burner, and a conventional propane tank 24 supplies fuel to the burner through a burner tube 25 (see also FIG. 11).

The base 21 includes an enlarged, generally rectangular bottom portion 26 and a vertically extending upper portion 27. A handle 28 is attached to the top of the base. The base is hollow and provides a chamber for the propane tank. The propane rectangular 29 is mounted on the top wall of the base, and flow through the regulator is controlled by a control knob 30 on the top of the base. The regulator includes a conventional internally threaded connector portion 31 into which the threaded connection of the propane tank is screwed.

Burner Assembly

Figure 7:
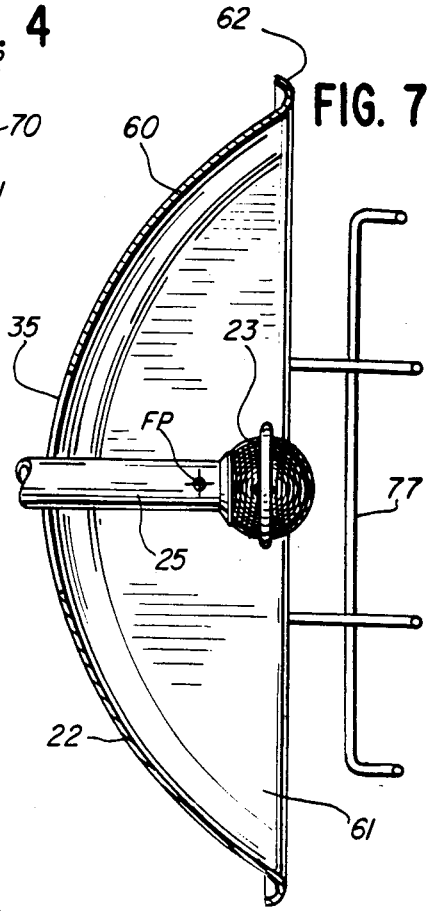
FIG. 7 is a sectional view through the reflector when the reflector is in its untilted position shown in FIG. 2.
Figure 8:
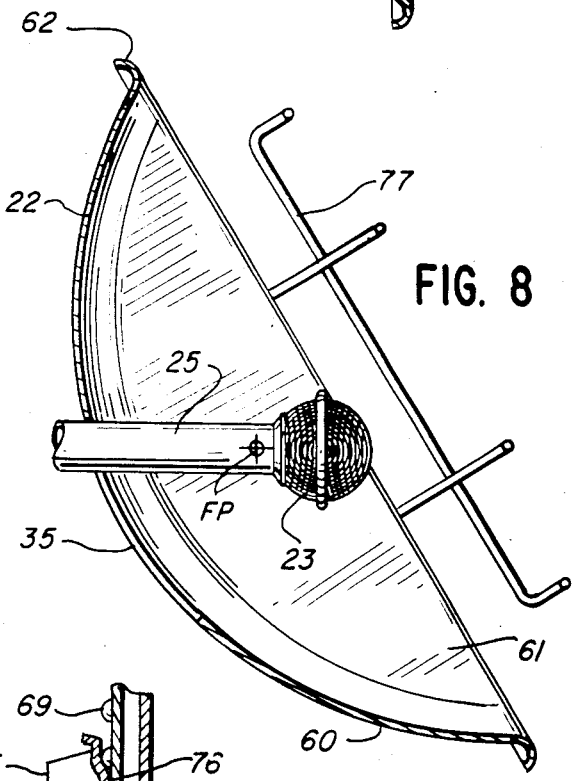
FIG. 8 is a sectional view through the reflector when the reflector is in the tilted position of FIG. 3.

Referring to FIG. 11, the burner tube 25 is generally Z-shaped and includes a first end portion 33 which is connected to the regulator 29 and a second end portion 34 which extends through a vertically elongated opening 35 in the reflector 22 (FIGS. 7 and 8). The burner tube is made of metal, and the rigidity of the tube maintains the position of the burner 23 even though the reflector is movable as will be described hereinafter. Combustion air opening 36 is provided in the burner tube adjacent the regulator 29, and combustion air is aspirated through the air opening by fuel flowing through the tube so that an air/fuel mixture is delivered to the burner.

Figure 13:
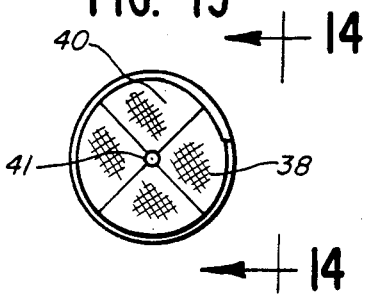
FIG. 13 is an end view of the port screen of the burner assembly.
Figure 14:
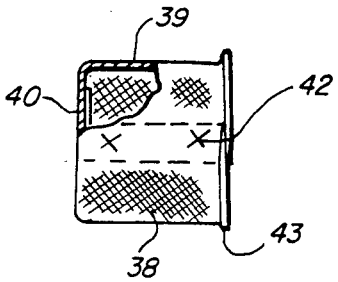
FIG. 14 is a side elevational view, partially broken away, of the port screen of FIG. 13.
Figure 15:
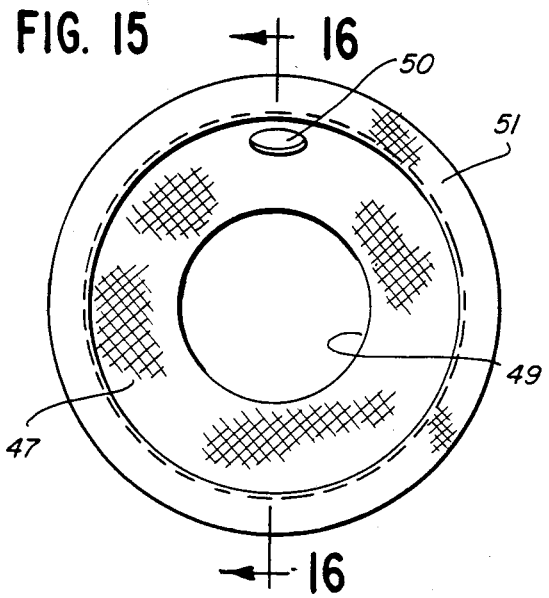
FIG. 15 is a top plane view of the inner hemisphere of the burner.
Figure 16:
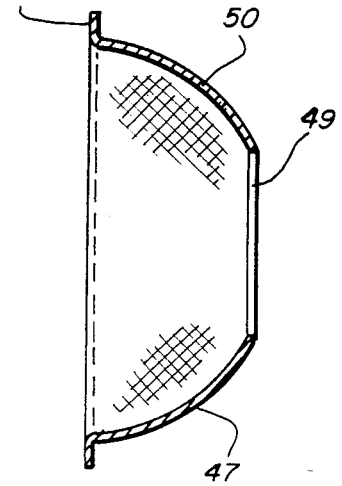
FIG. 16 is a sectional view taken along the line 16—16 of FIG. 15.
Figure 17:
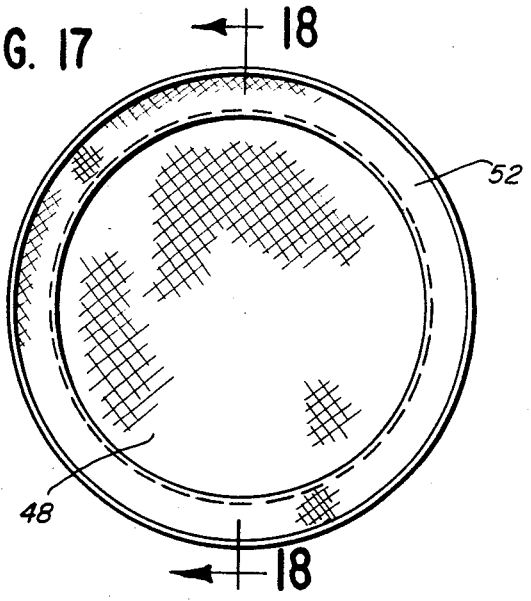
FIG. 17 is a bottom plan view of the outer hemisphere of the burner.
Figure 18:
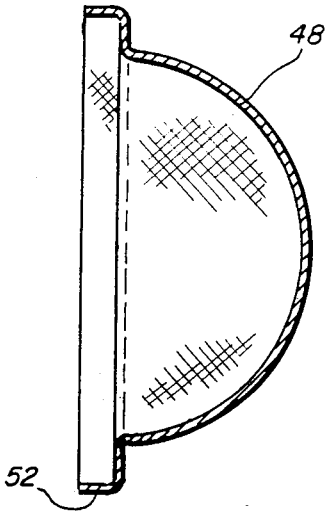
FIG. 18 is a sectional view taken along the line 18—18 of FIG. 17.
Figure 20:
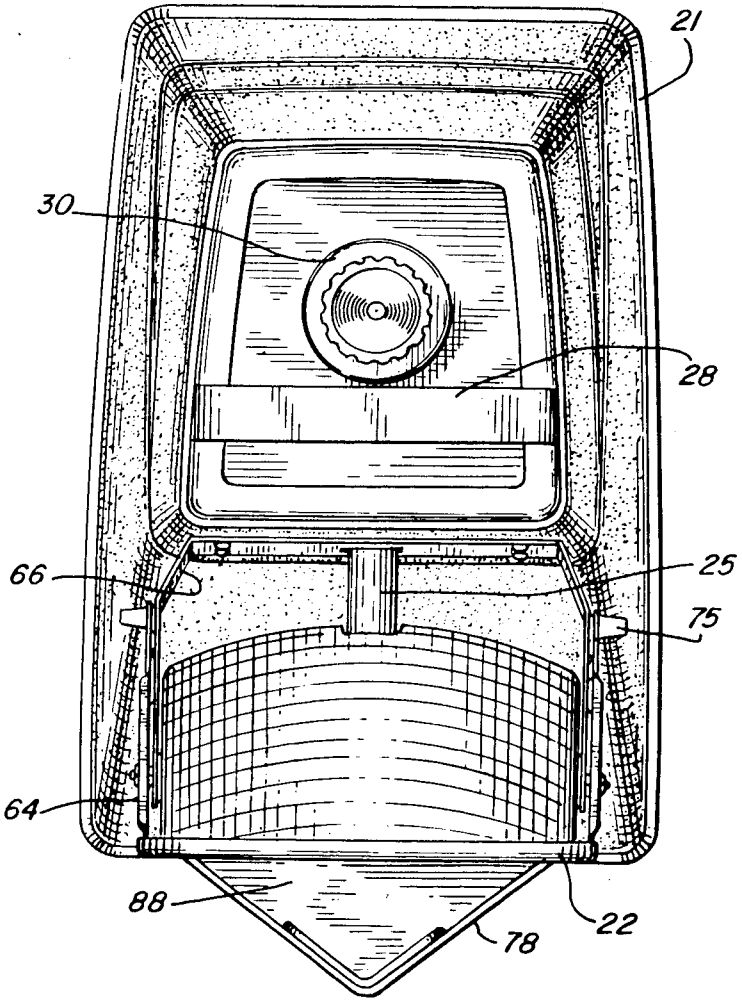
FIG. 20 is a top plan view of the heater.
Figure 19:
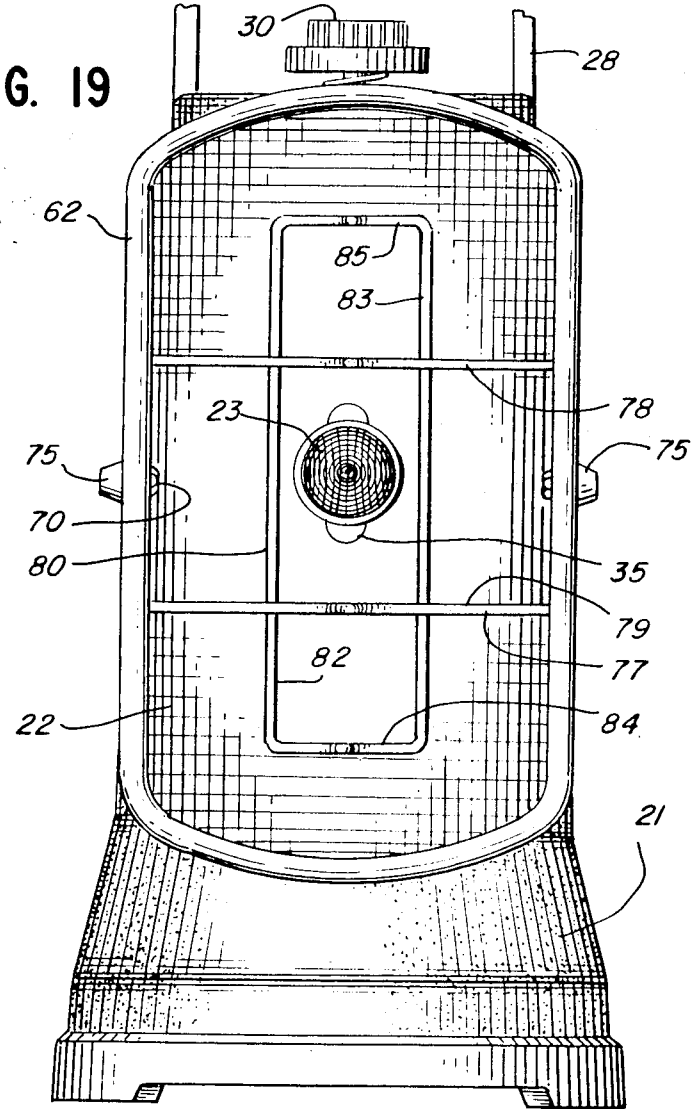
FIG. 19 is a front elevational view of the heater.

The burner head 23 includes a generally spherical burner screen 37 which is mounted on the outside of the burner tube and a generally cylindrical port screen 38 which is mounted on the inside of the burner tube. Referring to FIGS. 12–14, the port screen 38 is formed from a screen or wide cloth which is wrapped in a cylindrical shape to form a cylindrical side wall 39, and one end of the screen is folded to provide a closed end 40. A spotweld 41 on the end and two spotwelds 42 on the side secure the screen. The other end of the port screen is flared outwardly to provide an attaching flange 43.

As soon in FIG. 12, the attaching flange 43 of the port screen 38 is inserted into an annular recess 44 in the burner tube which is provided by an annular embossment or rib 45 in the tube.

Referring to FIGS. 15–18, the spherical burner screen 37 is formed from two generally hemispherically shaped screens or wire cloths 47 and 48. The inner hemisphere 47 is provided with an opening 49 through which the burner tube extends, a light opening 50, and a radially outwardly extending flange 51. The outer hemisphere 48 is intially formed with flange 52 which is L-shaped in cross section. The two hemispheres are joined by crimping the L-shaped flange 52 over the radial flange 51.

The spherical burner screen 37 is mounted on the burner tube 25 by inserting the burner tube through the opening 49 in the inner hemispherical screen 47 before the inner and outer hemisphericl screens are crimped together. A washer 53 (FIG. 12) is inserted between the rib 45 and the inner screen 47, and the end of the burner tube is then flared outwardly to provide a flange 54 which secures the inner screen against the washer 53. The flange 54 and the rib 45 define an annular recess 55 in the outside of the burner tube.

The burner is ignited by opening the regulator valve and inserting the match near the light opening 50 in the inner hemisphere of the burner. After the air/fuel mixture is ignited, the flame burns substantially entirely within the spherical burner, and radiant energy is reflected by the reflector 22.

The mesh of the cylindrical port screen 38 is relatively fine and the cylindrical side wall provides considerable area so that the flow of the air/fuel mixture from the burner tube into the burner is flowed down, thereby decreasing noise. The folded end 40 of the port screen decreases the porosity of the end and further reduces the flow rate through the end. The port screen diffuses the air/fuel mixture within the spherical burner screen and assists in reducing emissions of unburned hydrocarbons from the burner. The flame does not burn inside of the cylindrical port screen, and the port screen functions like a spark arrestor.

The mesh of the outer hemispherical screen 48 is finer than the mesh of the inner hemispherical screen 47. This forces a higher percentge of the burning air/fuel mixture to exit through the inner hemisphere 47, thereby retaining the mixture within the burner screen longer, reducing emissions, and increasing the temperature of the inner hemispherical screen. Since the inner hemispherical screen is closer to the reflector 22, the radiation efficienty of the heater is improved. The diameter of the burner is sized so that the pressure of the air/fuel mixture within the burner is greater than atmospheric pressure. This not only reduces emissions but makes the burner wind-resistant.

In one specific embodiment the port screen 38 was 40 mesh, the inner hemispherical screen was 30 mesh, and the outer hemispherical screen was 40 mesh. All of the screens were Inconel wire cloth type 600 or 601 with a wire diameter of 0.010 inch. The diameter of the cylindrical port screen 38 was 0.50 inch, and the length of the cylindrical port screen was 0.68 inch. The inside radius of the hemispherical screens 47 and 48 was 0.63 inch. This provided a burner with approximately 3500 to 5000 BTU per hour, depending upon the setting of the regulator 29.

Reflector

The reflector 22 includes a curved reflecting wall 60 (FIGS. 7–10) and a pair of flat side walls 61. The outer periphery of the walls is flared rearwardly to provide a smooth curved rim 62. The elongated opening 35 for the burner tube 25 is provided in the rear end of the reflector wall. The center of the opening 35 lies along the center line 63 (FIGS. 9 and 10) of the reflector. A pair of support arms or lever arms 64 are attached to the reflector and extend rearwardly along side the side walls 61 in line with the center line of the reflector.

Figure 5:
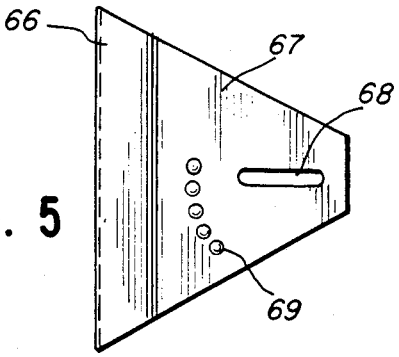
FIG. 5 is a side elevational view of the support bracket for the reflector.
Figure 6:
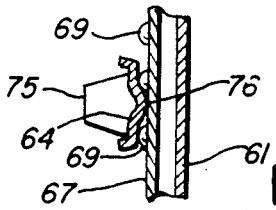
FIG. 6 is an enlarged fragmentary sectional view taken along the line 5—5 of FIG. 3.

A U-shaped support bracket 66 is mounted on the front wall of the base and includes a pair of forwardly extending parallel bracket plates 67. Referring to FIG. 5, each of the bracket plates is provided with an elongated slot 68 which extends parallel to the outer end portion 34 of the burner tube. A plurality of embossments 69 are formed in each bracket plate, and the embossments extend along an arcuate path.

Figure 4:
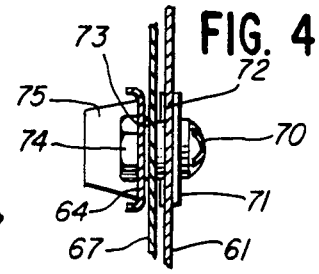
FIG. 4 is an enlarged fragmentary sectional view taken along the line 4—4 of FIG. 3.

Referring to FIG. 4, a bolt or screw 70 extends through a washer 71, a bolt hole in each of the reflector side walls 61, a washer 72, cylindrical spacer 73, and a bolt hole in one of the lever arms 64. The cylindrical spacer 73 extends through the elongated slot 68 in the bracket plate 67, and the diameter of the spacer is just slightly less than the width of elongated slot 68. A nut 74 is screwed onto the outer end of the screw 70 and clamps the lever arm tightly against the spacer 72 so that the lever arm is fixed with respect to the reflector. The forward end of each lever arm is bent inwardly toward the reflector side wall 61, and the forward end of the lever arm is clamped against the reflector side wall by the screw.

The bolts 70 and spacers 73 support the reflector for pivoting or tilting movement, and the spacers are slidable within the slots 68 in the bracket plates to permit the curved reflecting wall 60 to be moved toward or away from the burner. The outer end of each lever arm 64 extends laterally outwardly, and a knob 75 of insulating plastic is mounted thereon. The reflector can be moved by gripping the knobs.

A rib 76 is formed in the rear portion of each of the lever arms 64 and is engageable with the embossments 69 on the bracket plate as the lever arm pivots about the bolt 70. The embossments provide detents which hold the reflector in various tilted positions.

The curved reflecting wall 60 is in the shape of a parabola and has a focal point designated F.P. in FIGS. 7–10. The focal point can be moved relative to the burner by sliding the bolts 70 along the slots 68 in the bracket plates.

In FIG. 9 the focal point is behind the burner and the radiant energy from the rear half of the burner is dispersed by the reflecting wall 60 as indicated by the arrows. In FIG. 10 the focal point is centered within the rear half of the burner, and radiant energy from the rear half of the burner is focused by the reflector wall 61 and reflected forwardly in a concentrated beam in a direction parallel to the center line of the reflector.

The forward ends of the elongated slots 68 in the bracket plates provide forward stops for the spacers 73 and the reflector. The ends of the slots are advantageously positioned so that the focal point of the reflector is centered within the rear half of the burner when the spacers abut the forward ends of the slot.

Safety Guard

A safety guard 77 is mounted on the reflector to prevent objects from contacting the burner. The guard is formed from a pair of V-shaped wire rods 78 and 79 (FIGS. 1, 2, 19, and 20) which project forwardly from the side walls 61 of the reflector and a generally rectangular wire rod 80 which extends between the V-shaped rods. The rectangular rod 80 includes a pair of side portions 82 and 83 which extend parallel to the side walls 61 of the reflector and a pair of V-shaped end portions 84 and 85. The parallel rods 82 and 83 are welded to the inside of the V-shaped rods 78 and 79, and the apex of each of the V-shaped rods 84 and 85 is spaced slightly inwardly from the apex of the V-shaped rods 78 and 79.

The ends of the V-shaped rods 78 and 79 extend through holes in the side walls 61 of the reflector. The ends 86 (FIG. 2) of the rod 78 and turned upwardly, and the ends 87 of the rod 79 are turned downwardly to hold the guard on the reflector. The ends of the rods 78 and 79 can be flexed inwardly in order to insert them into the holes in the reflector, and the resilient rods will return to their initial positions after insertion in order to hold the guard on the reflector.

A triangular shield 88 (FIGS. 1 and 20) is welded to the lower V-shaped rod 79 to shield radiant energy from the surface which supports the heater.

The reflector and safety guard are lightweight, and most of the weight of the heater is provided by the propane tank. The center of gravity of the heater is therefore well behind the reflector and is substantially in line with the propane tank. If the heater is accidentally tipped over so that the safety guard contacts the supporting surface, the V-shaped safety guard will cause the heater to roll over to one side or the other. The safety guard therefore ensures that the reflector will not direct heat or radiant energy toward the supporting surface.

The dimensions of the base of the heater are such that after the safety guard causes the heater to roll over on its side, the heater will be supported by the sides of the top and bottom base and by the insulating hand knobs 75. The hot reflector will therefore be supported out of contact with the surface.

While in the foregoing specification a detailed description of a specific embodiment was set forth for the purpose of illustration, it will be understood that many of the details herein given may be varied considerably by those skilled in the art without from the spirit and scope of the invention.

I claim:

1. A radiant heater comprising a base, reflector mounted on the base, the reflector including a curved reflecting wall having a focal point, a burner tube mounted on the base and extending through an opening in the reflector, a burner head on the end of the burner tube, a pair of spaced-apart bracket plates mounted on the base, each of the bracket plates having an elongated slot, and a pair of slide means mounted on the reflector, each of the slide means extending through the slot in one of the bracket plates and being movable along the length of the slot for slidably supporting the reflector, the slide means being pivotable within the slots of the bracket plates whereby the reflector is tiltably mounted on the base to permit tilting movement of the reflector relative to the burner head and the slide means are movable in the slots in the bracket plates to permit movement of the curved reflecting wall of the reflector and the focal point thereof toward and away from the burner head so that radiant heat energy from the burner can be focused and dispersed by the reflector wall.

2. The heater of claim 1 in which the reflector is movable to a position in which the focal point is within the burner head whereby the radiant heat energy is focused and directed substantially straight from the reflecting wall.

3. The heater of claim 2 in which the reflector is also movable to a position in which the focal point is between the burner head and the reflecting wall whereby the radiant heat energy is dispersed.

4. The heater of claim 1 in which the focal point of the reflecting wall is positioned within the burner head when each of the slide means is at one end of the associated elongated slot.

5. The heater of claim 1 in which each of the slide means comprises a cylindrical spacer.

6. The heater of claim 1 including a lever arm attached to each of the slide means.

7. The heater of claim 6 in which each of the lever arms is attached to the associated slide means by a screw and includes a forward end portion which extends laterally inwardly toward the reflector and is clamped against the reflector by the screw.

8. The heater of claim 1 including a lever arm attached to each of the slide means and detent means on at least one of the bracket plates engageable with at least one of the lever arms for releasably holding the lever arm at a plurality of angular positions relative to the slot in the bracket plate whereby the reflector can be positioned in a plurality of tilted positions.

9. The heater of claim 8 which said detent means comprises a plurality of raised embossments on said one bracket plate and said one lever arm is provided with a projection which is engageable with the embossments.

10. The heater of claim 8 which each of the lever arms extends along the outside of the associated bracket plate and includes an outwardly extending end portion, and a heat-insulating knob mounted on the outwardly extending end of each lever arm whereby the reflector can be moved by gripping the knobs and moving the lever arms.

11. The heater of claim 1 in which the reflector includes a parabolic rear reflecting wall and a pair of flat side walls and said means for pivotally mounting the reflector provide a pivoting axis for the reflector which extends through the side walls forwardly of the parabolic rear wall.

12. The heater of claim 11 in which the pivoting axis is generally aligned with the focal point of the parabolic rear wall.

13. A radiant heater comprising a base, a pair of space-apart bracket plates mounted on the base, a reflector positioned between the bracket plates, a burner tube fixedly mounted on the base and extending through an opening in the reflector, a burner head on the end of the burner tube, means for pivotally mounting the reflector on the bracket plates to permit tilting movement of the reflector relative to the burner head, a lever arm connected to the reflector and extending along one of the bracket plates, and detent means on said one bracket plate engageable with the lever arm for releasably holding the lever arm at a pluraltiy of angular positions whereby the reflector can be positioned in a plurality of tilted positions.

14. The heater of claim 13 in which said detent means comprises a plurality of raised embossments on said one bracket plate and said lever arm is provided with a projection which is engageable with the embossments.

* * * * *

UNITED STATES PATENT AND TRADEMARK OFFICE

CERTIFICATE OF CORRECTION

PATENT NO. : 4,569,329

DATED : February 11, 1986

INVENTOR(S) : John T. Cherryholmes

It is certified that error appears in the above-identified patent and that said Letters Patent is hereby corrected as shown below:

Col. 5, line 31 insert --a-- before "reflector".

Col. 6, line 21 insert --in-- after "8".

Col. 6, line 25 insert --in-- after "8".

Signed and Sealed this

*First* Day of *July 1986*

[SEAL]

*Attest:*

DONALD J. QUIGG

*Attesting Officer*

*Commissioner of Patents and Trademarks*